US008353119B2

(12) United States Patent
Hanner et al.

(10) Patent No.: US 8,353,119 B2
(45) Date of Patent: Jan. 15, 2013

(54) IRON HOLDER

(75) Inventors: Gert Hanner, Höganäs (SE); John P. Berg, Helsingborg (SE)

(73) Assignee: Badd & Bad AB, Helsingborg (SE)

( * ) Notice: Subject to any disclaimer, the term of this patent is extended or adjusted under 35 U.S.C. 154(b) by 286 days.

(21) Appl. No.: 12/526,280

(22) PCT Filed: Feb. 7, 2008

(86) PCT No.: PCT/SE2008/050155

§ 371 (c)(1),
(2), (4) Date: Oct. 26, 2010

(87) PCT Pub. No.: WO2008/097189

PCT Pub. Date: Aug. 14, 2008

(65) Prior Publication Data

US 2011/0047836 A1 Mar. 3, 2011

(30) Foreign Application Priority Data

Feb. 7, 2007 (SE) ..... 0700297
Feb. 8, 2007 (SE) ..... 0700314

(51) Int. Cl.
*D06F 79/02* (2006.01)
*D06F 81/00* (2006.01)

(52) U.S. Cl. ..... 38/96; 248/117.2

(58) Field of Classification Search ..... 219/246, 219/259; 248/117.1–117.7; D32/73; 38/79, 38/96, 97, 142
See application file for complete search history.

(56) References Cited

U.S. PATENT DOCUMENTS

| | | | | | |
|---|---|---|---|---|---|
| 565,350 | A | * | 8/1896 | Hall | 248/117.1 |
| 1,759,214 | A | | 5/1930 | Winters | |
| 1,881,144 | A | * | 10/1932 | Stein | 248/117.4 |
| 2,844,343 | A | * | 7/1958 | Bergner | 248/117.2 |
| 2,866,614 | A | * | 12/1958 | Lael | 248/117.7 |
| 2,879,021 | A | | 3/1959 | Dry | |
| 2,982,506 | A | * | 5/1961 | Allen | 248/117.2 |
| 3,062,492 | A | | 11/1962 | Hedger | |
| 3,176,947 | A | | 4/1965 | Inverso | |
| 3,426,990 | A | * | 2/1969 | Pady | 248/117.6 |
| 4,368,863 | A | | 1/1983 | Gentile | |
| 2004/0075029 | A1 | | 4/2004 | Clausen et al. | |
| 2010/0199529 | A1 | * | 8/2010 | Ma et al. | 38/77.1 |

FOREIGN PATENT DOCUMENTS

WO WO 90/12915 11/1990

* cited by examiner

*Primary Examiner* — Ismael Izaguirre
(74) *Attorney, Agent, or Firm* — Merchant & Gould P.C.

(57) ABSTRACT

An iron holder is provided allowing for fixation of an iron, such that the iron holder, and thereby also the iron housed therein, may be moved in all directions without the iron falling off the iron holder, while simultaneously keeping the heating surface of the iron in a covered position, such that said heating surface will not pose a threat to the health of the user or pose a risk for setting fire to flammable materials.

14 Claims, 7 Drawing Sheets

IRON HOLDER

FIELD OF THE INVENTION

This invention pertains in general to the field of an iron holder for holding irons for ironing clothes and the like. More particularly the invention relates to an iron holder comprising a base plate and holding means mounted thereon.

BACKGROUND OF THE INVENTION

In the technical field of irons for ironing clothes etc., and holders for such irons, there may be problems accompanied the storing of the ironing equipment, such as irons, iron boards, etc. This is especially true with regard to storing ironing equipment in small spaces, such as hotel rooms or small apartments, where the storing space often is very limited. In these cases it is desired to provide storage for an iron and iron board when not in use, in a minimized space.

In this respect iron holders are provided, which for example may be attached to a support wall where the ironing of clothes is typically done. The support wall may also be a closet door or cabinet door. However, such iron holders can be attached to a support wall in only one orientation. Depending on the space provided in a cabinet or a closet in which the iron holder is mounted, or the position of the iron holder on a wall on which the iron holder is mounted, the iron holder may not be easily accessible to the user. Furthermore, the iron holder may not have provisions for storage of the power cord of the iron to be housed in the iron holder or accessories, such as an ironing board.

US 2004/0075029 discloses a holder for an iron for ironing clothes. This holder comprises a base plate, to be mounted on for example a wall, and a support arm, onto which the iron may be hung. The iron holder according to US 2004/0075029 is however accompanied by several problems. Firstly, the support arm has to be inserted in the opening providing the handle of the iron, thereby occupying the handle, which results in an inconvenient handling procedure to the user, since the hand of the user cannot grip the handle of the iron in the contemplated way. Secondly, if the iron holder is mounted on a surface that is movable, the iron holder fails to hinder the iron from falling off in at least one direction, i.e. in the direction the support arm is directed. Thirdly, the mounting of the iron holder renders it inconvenient for use of both right and left handed users, since the mounting of the iron holder fixates the direction in which the iron is removed from the iron holder, and right and left handed users preferably removes an iron in opposite directions.

WO 90/12915 discloses another iron holder for holding an iron. This iron holder comprises a base, which is attached to a board or wall and a cage for holding an iron to increase the stability of the iron on the board, which has been placed on end in an upright position. The cage comprises a front portion for preventing forward tipping of the iron, and two side portions, which hold the iron against falling sidewards. The iron holder according to WO 90/12915 is however accompanied by several problems. Firstly, the cage does not prevent the iron from moving forward and upward, which renders the iron holder unsuitable for holding an iron on a movable surface, such as the surface of the ironing board, which ironing board conveniently is movable into and out from a wardrobe. Secondly, when the iron is placed in an upright position, the heating surface is uncovered, resulting in health hazard to the user or pose a risk for setting fire to flammable materials.

U.S. Pat. No. 3,062,492 discloses a holder for a household appliance, such as an iron. Moreover, the holder is capable of vertical mounting which may contain both electrical steam or dry irons. However, a problem with U.S. Pat. No. 3,062,492 is that the holder is adapted for a specific iron having a certain size and shape. This results in that only irons having a certain size and shape may be connected to the holder.

U.S. Pat. No. 2,879,021 discloses a holder for electric irons such as steam or dry irons normally used in the home, and more particularly to wall brackets or holders for such irons. However, a problem with U.S. Pat. No. 3,062,492 is that the holder is adapted for a specific iron having a certain size and shape. This results in that only irons having a certain size and shape may be connected to the holder.

Hence, an improved iron holder would be advantageous and in particular an iron holder allowing for fixation of an iron, such that the iron holder, and thereby also the iron housed therein, may be moved in all directions without the iron falling off the iron holder, while simultaneously keeping the heating surface of the iron in a covered position, such that said heating surface will not pose a threat to the health of the user or pose a risk for setting fire to flammable materials. Also, an iron holder allowing for minimized discrimination between left and right-handed users would be advantageous. Furthermore, it would be advantageous to provide an iron holder that minimizes the storing space of the ironing equipment, such as the iron, ironing board, etc.

SUMMARY OF THE INVENTION

Accordingly, the present invention preferably seeks to mitigate, alleviate or eliminate one or more of the above-identified deficiencies in the art and disadvantages singly or in any combination and solves at least the above mentioned problems by providing an iron holder according to the appended patent claims.

According to one aspect of the invention, an iron holder is provided. The iron holder comprises a base plate configured to attach a holding means by means of a set of indentations. The holding means comprises an iron tip holder having a rail for fitting into a recess or groove situated vertically above the heating surface of an iron, the rail extending at least partly along the sides of the iron. Moreover, the holding means comprises a rear holder mounted on the base plate by means of an indentation for providing a stopping action of the iron in a direction away from the iron tip holder, whereby the iron is prevented from moving out of the iron holder in the plane parallel to the base plate. Furthermore, the holding means comprises a first side holder, and a second side holder, each cooperating with the sides of the iron when the iron is placed in the iron holder, wherein the first side holder is attached to either a first indentation or second indentation of the set of indentations, and wherein the space for reception of the width of the iron, between the first side holder and second side holder, is dependent on to which of the first or second indentation the first side holder is attached.

According to one aspect of the invention, n base plate for being comprised in an iron holder is provided. The base plate is configured to attach a holding means by means of a set of indentations provided thereon. The holding means comprises a first side holder, and a second side holder, each cooperating with the sides of an iron when the iron is placed in the iron holder, wherein the first side holder is attached to either a first indentation or second indentation of the set of indentations, and wherein the space for reception of the width of the iron, between the first side holder and second side holder is dependent on to which of the first indentation or second indentation the first side holder is attached.

The iron holder according to some embodiments of the invention allows for fixation of an iron, such that the iron holder, and thereby also the iron housed therein, may be moved in all directions without the iron falling off the iron holder, while simultaneously keeping the heating surface of the iron in a covered position, such that the heating surface will not pose a threat to the health of the user or pose a risk for setting fire to flammable materials. Based on the design of the iron holder, it allows for minimized discrimination between left and right-handed users. Furthermore, the iron holder according to some embodiments minimizes the storing space of the ironing equipment, such as the iron, ironing board, etc.

Furthermore, when placed on a ironing board or hanged on a hanger the iron holder will keep the heating surface of the iron in a covered position, such that the heating surface will not pose a threat to the health of the user or pose a risk for setting fire to flammable materials.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF EMBODIMENTS

Several embodiments of the present invention will be described in more detail below with reference to the accompanying drawings in order for those skilled in the art to be able to carry out the invention. The invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments do not limit the invention, but the invention is only limited by the appended patent claims. Furthermore, the terminology used in the detailed description of the particular embodiments illustrated in the accompanying drawings is not intended to be limiting of the invention.

It is an object of the invention to provide an iron holder that may be used for a large number irons having different shapes and sizes. Moreover, it is an object of the invention to provide an iron holder that is simple with reduced manufacturing costs compared to current solutions.

The following description focuses on embodiments of the present invention applicable to an iron holder and in particular to an iron holder comprising a base plate and holding means mounted thereon. However, it will be appreciated that the invention is not limited to this application but may be applied to many other applications.

Figure 1:
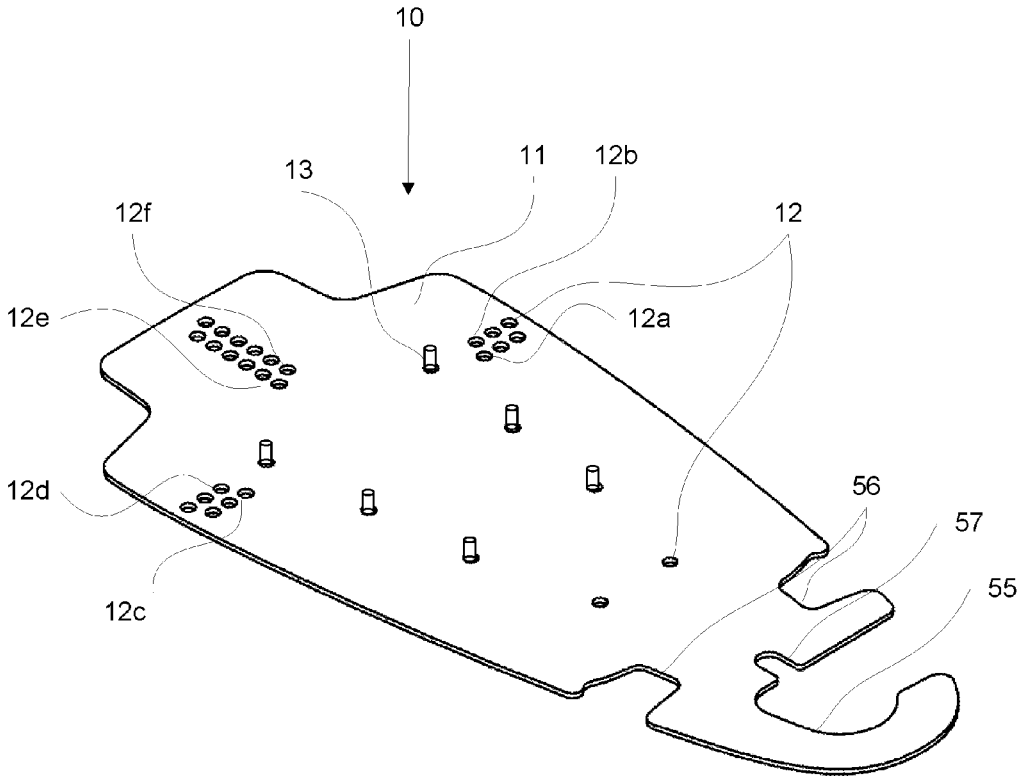
FIG. 1 is an illustration showing an iron holder according to an embodiment of the invention.

In an embodiment of the invention according to FIG. 1, an iron holder 10 is provided. The iron holder 10 comprises a base plate 11, which is used as frame for the iron. The base plate is provided with indentations 12, 12*a*-12*f*, the purpose of which is to enable attachment of a holding means (not shown). Depending on to which indentation the holding means, or part of the holding means, is attached, this will affect the possible reception shape and size of the holder. In this way, the iron holder may easily be adapted to receive any commercially available iron having a certain size or shape using a set of desired indentations in the base plate.

Figure 2:
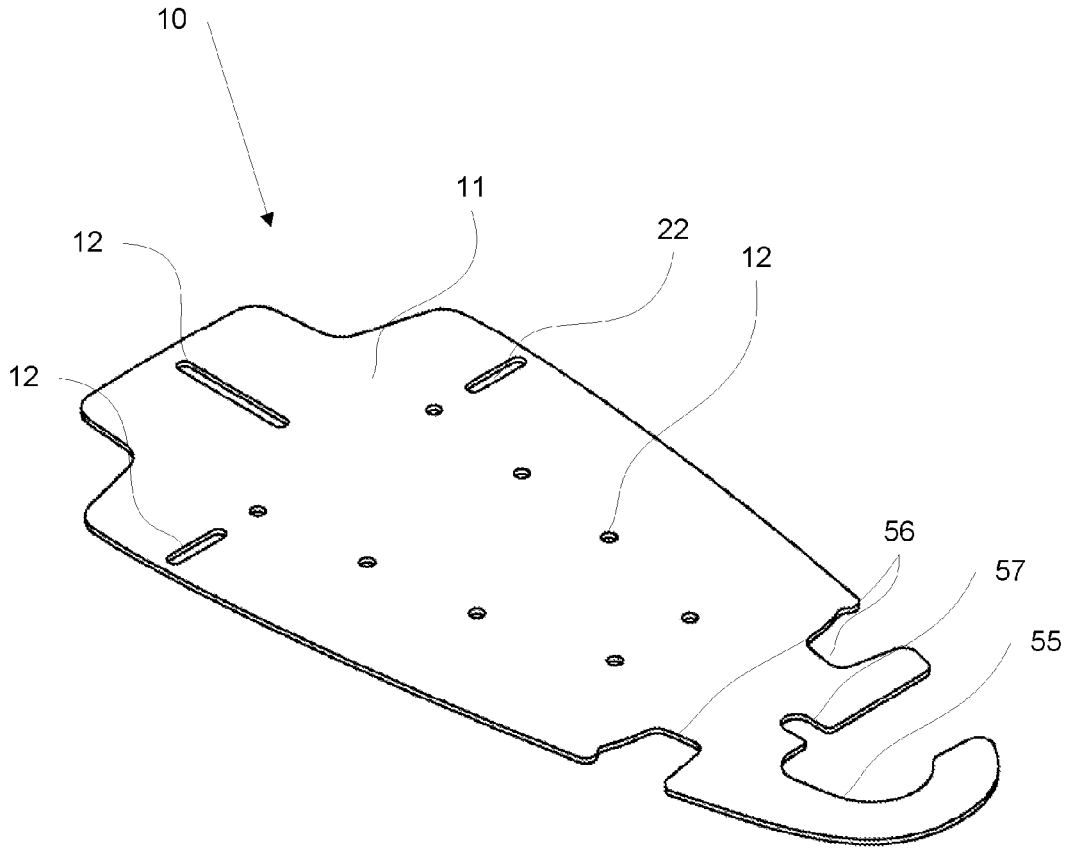
FIG. 2 is an illustration showing an iron holder according to another embodiment of the invention.

In an embodiment the indentations are holes provided straight through the base plate. In other embodiments the indentations may be holes, recesses, incisions, notches, slits, or grooves, etc. FIG. 2 illustrates a base plate according to an embodiment of the invention comprising a combination of different indentations 12, 22. Accordingly, instead of attaching the holding means to a hole, such as indentation 12*a*, or 12*b*, the holding means may be attached to a slit 22. It should be appreciated that any combination of indentations provided in the base plate is possible.

For example, depending on the type of holding means the type of indentation may be varied, and inversely the type of holding means may be varied depending on the type of indentation, in order to securely attach the holding means to the indentations.

Material—Base Plate

The base plate may be of any suitable material, such as a metal, such as aluminium, stainless steel, etc., or thermal resistive plastic material. In some embodiments the material comprises thermo isolative characteristics to isolate the heat from the iron to the other side of the base plate.

In some embodiments the base plate has a thickness of approximately a few millimetres, such as 1 mm to 10 mm. Due to the thermo isolative characteristics the holder may be directly attached to an ironing board without risk of overheating the ironing board even when the iron is hot.

Distance Means

In an embodiment the base plate is provided with distance means 13 that are fasten in some indentations and protrude in the direction away from the base plate. When the base plate is placed on a surface, e.g. ironing board, or when the iron is placed on the base plate, with the distance means 13 protruding towards the surface or iron, a distance is created between the surface or iron and the base plate. This distance provides further thermal isolation and hence the surface will not be damaged when the base plate with a hot iron is placed on top.

In an embodiment the iron holder 10 comprises distance means 13 being provided on both sides of the base plate 11. In this way two distances are created between the base plate 11 and the surface, when the iron holder is placed on a surface, and between the base plate 11 and the iron, when the iron is placed on the iron holder 10, respectively. Accordingly, thermal isolation is accomplished on both sides of the base plate 11.

The distance means 13 may e.g. be a plug, spacer, or any other suitable means for creating a distance to the base plate. The length of the distance means may e.g. be between 1 to 25 mm or more to establish the thermal isolation space to avoid damage on the ironing board.

In some embodiments the indentation provided in the base plate 11 is threaded. In these embodiments the distance means correspondingly may have an end provided as a screw type for fitting in the threaded base plate indentations. In this way the distance means may be securely fastened to the base plate 11.

Holding Means

In an embodiment the iron holder comprises a holding means for fixation of an iron to the iron holder. The purpose of the holding means is to provide a securing of the iron, such that the iron holder, and thereby also the iron housed therein, may be moved in all directions without the iron falling off the iron holder. The holding means may be attached on the base plate via the indentations 12, 12*a* to 12*f*, 22, as explained above, e.g. in the same manner as the distance means.

Tip Holder

Figure 3A:
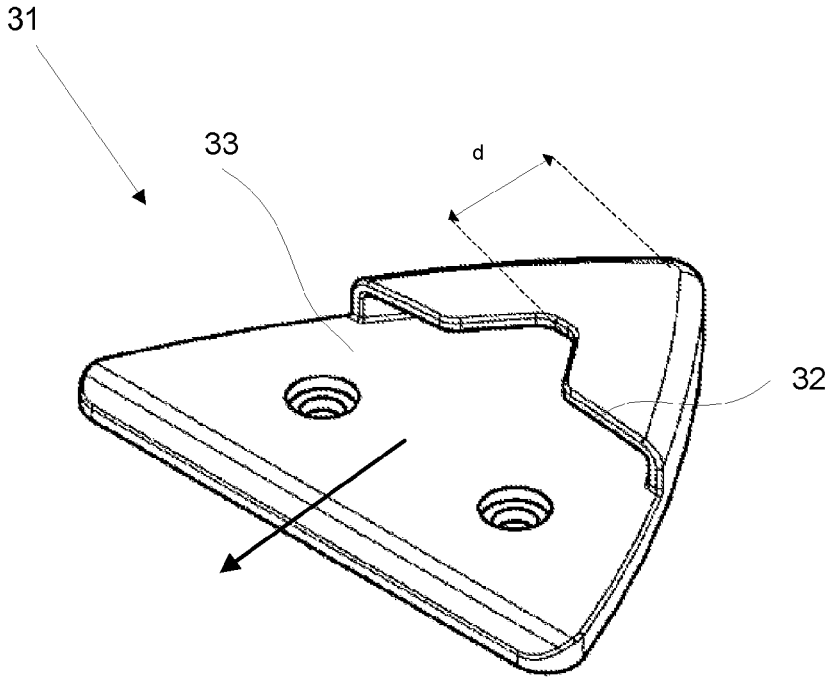
FIG. 3*a* is an illustration showing an iron tip holder according to an embodiment of the invention.

In an embodiment, according to FIG. 3*a*, the holding means comprises an iron tip holder 31. The iron tip holder 31 is provided with a rail 32. The rail 32 of the tip of the iron tip holder 31 is shaped to be able to comprise the tip of the iron. Most currently available irons have a distance between the heating surface and the iron housing, such as a recess or groove, situated above the heating surface and extending around the iron. Hence, the distance, i.e. vertical distance when the iron holder is placed horizontally, between the base surface 33 and the lower edge of the rail 32 is slightly larger than height of the iron heating surface, such that the iron heating surface may be contained in the space defined by the bottom surface 33 and the rail 32. The rail 32 of the iron tip holder 31 is provided to fit into the iron recess or groove, and as the rail setup is shaped like the tip of the iron, the tip when inserted into the iron tip holder 31 will become fixated in all directions except in the rear direction, which is illustrated by a solid arrow in FIG. 3*a*.

The iron tip holder may be attached to the base plate via any number of indentations provided on the base plate. In some embodiments the iron tip holder is fastened via only one indentation, and in other embodiments more than one indentation is used for fastening, such as two or three indentations.

Figure 3B:
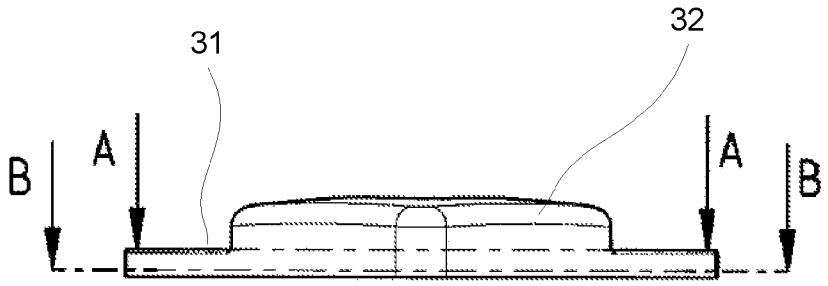
FIG. 3*b* is an elevation view showing an iron tip holder according to an embodiment of the invention.

FIG. 3*b* illustrates the iron tip holder in elevation view and the distance between indications A and B may be used for defining the length of the distance means, such that the iron heating surface is substantially parallel with the base plate.

Side Holder

The holding means may further comprise two side holders 51, 53 that are provided on the base plate by means of the indentations 12, 12*a*, 12*b*, 12*c*, 12*d*, 22, etc. as explained above. The function of the side holders is to prevent the iron, when placed on the base plate 11, from moving, as the side holders will block the way of movement. In this way an iron placed in the holder does not risk to undesirably fall off the holder. Each side holder may be placed in any one or a combination of indentations 12. For example, for a narrow iron the side holders may be attached using indentation 12*a* and 12*c*, respectively. However, for an iron with larger width indentations 12*b*, and 12*d* could be utilized. Optionally, the first side holder may be attached using indentation 12*a*, while the second side holder may be attached using indentation 12*d*.

Rear Holder

The holding means may further comprise a rear holder 52 that is provided on the base plate 11 by means of the indentations 12, 12*e*, 12*f* as explained above. The function of the rear holder is in similarity with the side holders to prevent the iron, when placed on the base plate 11, from moving as the rear holder will block the way of movement. In this way an iron placed in the holder does not risk to undesirably fall off the holder.

Figure 4A:
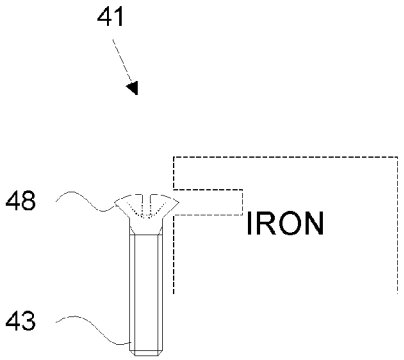
FIGS. 4*a* to 4*d* is an illustration showing a side or rear holder according to an embodiment of the invention.

In an embodiment, according to FIG. 4*a*, the side or rear holder 41 is a screw, with the same functionality as the iron tip holder, meaning that the screw or nail head portion 48 may be used to protrude into the recess or groove above the iron heating surface, as explained above, when the iron is placed in the iron holder. An advantage of a screw is that it may be easy to mount on the base plate 11. Other shapes similar to screws may also be used, such as nails or plugs, etc. The screw, nail or plug has a bottom portion 43, which may be threaded or have any other shape enabling the bottom portion to be securely fasten to the indentations of the base plate 11.

In an embodiment, the side or rear holder comprises a screw which may be provided in an indentation straight through the base plate and be locked by a nut receiving the screw on the opposite side of the base plate.

Figure 4B:
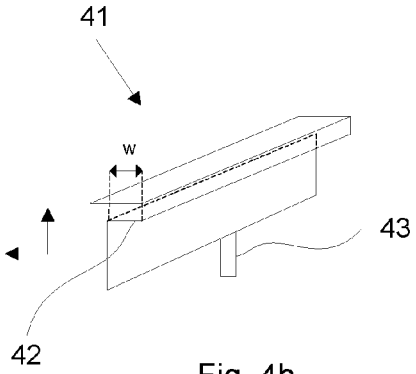

In another embodiment, according to FIG. 4*b*, the side or rear holder 41 comprises a rail 42 having the same functionality as the rail of the iron tip holder, meaning that the rail 42 is adapted to fit into the recess or groove located above the iron heating surface, when the iron is placed on the base plate 11. Hence, the iron will be blocked from moving in all directions except from the direction in which the rail 42 protrudes from the side or rear holder 41. The side or rear holder as well as the iron tip holder may be provided with an attachment means 43 for attaching the side or rear holder to the base plate 11 via the indentations. In some embodiments the attachment means 43 is integrated into the side or rear holder 41.

Figure 4C:
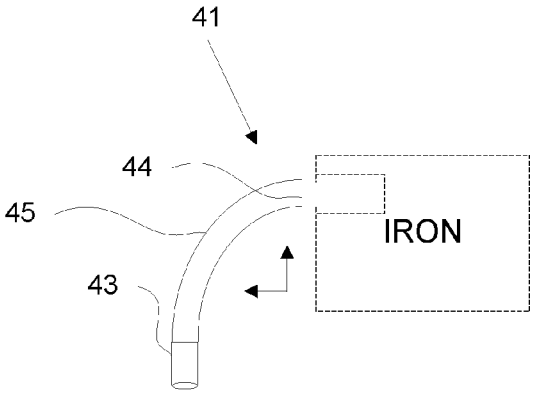
Figure 4D:
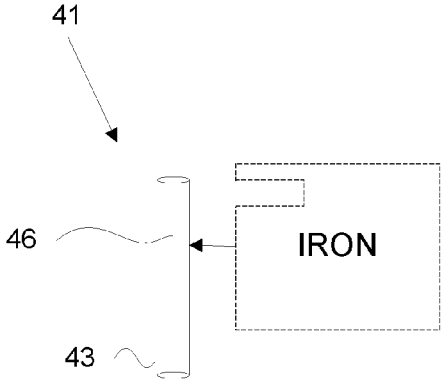

FIGS. 4*c* and 4*d* illustrates two embodiments of different shapes of the side or rear holder 41. In FIG. 4*c* the side or rear holder 41 is provided as a curved cylindrical structure 45, having a head portion 44 adapted to fit in the recess or groove of the iron.

The side or rear holder according to some embodiments is not limited to be adapted to fit into the recess or groove located above the iron heating surface. In FIG. 4*d* the side or rear holder 41 is provided as a straight cylindrical structure 46, which will prevent the iron from moving beyond the side or rear holder 41. The prevented directions are indicated as a solid two-way arrow in FIG. 4*d*. Any of the side or rear holders may be equipped with a spring, as explained above, to provide a pressing action on the iron when placed in the iron holder.

Spring Mechanism

In an embodiment a spring mechanism (not shown in FIG. 4*b*) is provided on the iron tip holder. The spring mechanism provides a pressing action of the iron tip holder on the iron in the direction towards the rear holder, and hence securely locks the iron to the iron holding means, in form of the side and rear holder. The advantage of this embodiment is that the spring accordingly provides a pressing action in the direction towards the iron, which improves the attachment of the iron to the iron holder.

In an embodiment the iron tip holder is fixedly mounted on the base plate, but comprises a spring mechanism e.g. provided in the space created by the rail 32 and the bottom surface 33 of the iron tip holder. The spring mechanism may be provided as a member of flexible material providing a spring type action on the iron, when provided in the iron tip holder. This flexible material may be a heat-resistant rubber or any other suitable material. In other embodiments the spring mechanism comprises a spring having a pressing member. The spring mechanism is used to press the front part of the iron, i.e. heating surface, being contained in the space, backwards towards the rear holder. This pressing action will securely fasten the iron to the iron holder. The pressing member of the spring mechanism may be shaped to correspond to the front part of the iron, for efficiently and securely pressing the iron. Due to the friction between the heating surface of the iron and the rear holder, in conjunction with the type of the rear holder the iron will be securely attached to the iron holder.

The side or rear holder may also comprise a similar spring mechanism to achieve the same functionality of securely locking the iron to the iron holder.

In an embodiment the distance means 13 comprises a spring mechanism, which provides a pressing action against the heating surface of the iron, when the iron is placed in the iron holder. To attach the iron to an iron holder according to this embodiment, the iron may first be inserted into the tip holder, and then pressed downwards counteracting the spring mechanism of the distance means. When the heating surface of the iron is in alignment with the rear holder, the iron may be moved horizontally backwards, in the direction away from the iron tip holder. If the rear holder has a rail this will connect to the recess or groove situated above the heating surface of the iron. Due to the spring mechanism of the distance means the heating surface of the iron will be pressed upwards against the rail of the iron tip holder and the head portion, end portion, or rail of the rear holder. The iron will thus be securely fastened to the iron holder, by means of the friction force between the rear holder and iron tip holder and the heating surface of the iron, and by the pressing action of the distance means. In this embodiment the length of the distance means in its fully elongated condition is advantageously larger than the final distance between the bottom of the heating surface of the iron and the base plate. This means that the distance means will be able to press the heating surface of the iron against the iron tip holder rail and the rear holder in an upward direction, when the iron holder is oriented horizontally. By varying the area or shape of the top surface of the distance means being in connection with the iron when placed in the holder, the horizontal friction force between the distance means and the heating surface of the iron may be changed.

In some embodiments a spring mechanism is provided on at least one of the distance means or iron tip holder, side holder or rear holder.

The spring mechanism may be provided as a flexible material instead or in conjunction with a spring.

Figure 5:
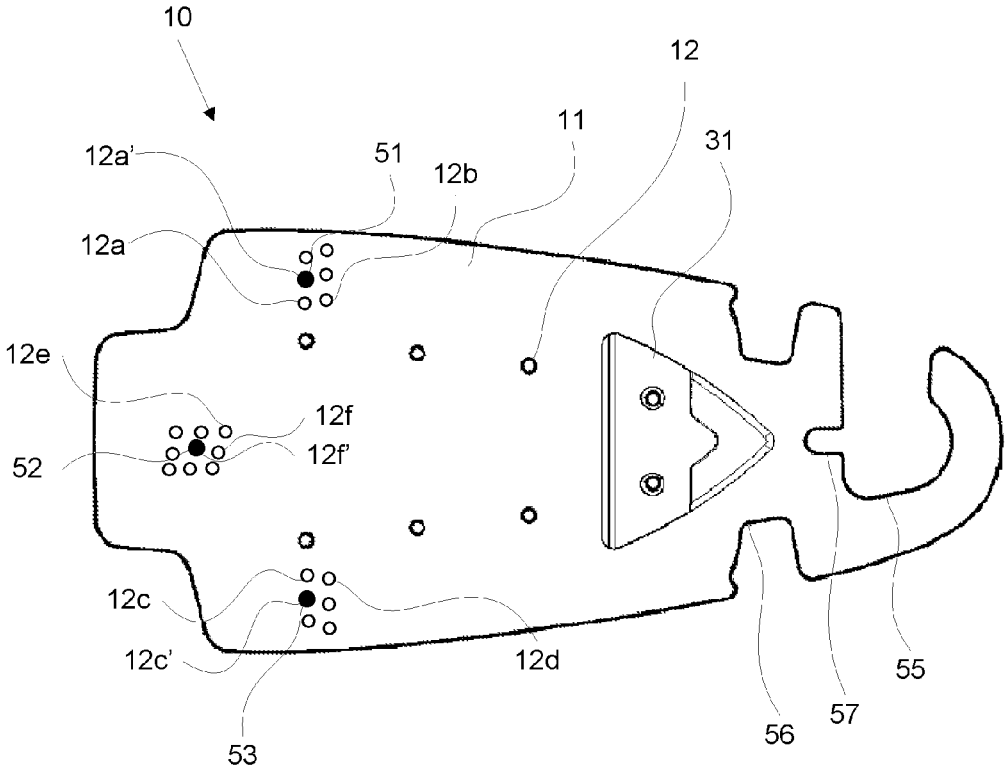
FIG. 5 is an illustration showing an iron holder according to an embodiment of the invention.

FIG. 5 illustrates an embodiment of the invention, in which two side holders 51, 53, e.g. being of the type illustrated in FIG. 4*d* and attached via indentation 12*a*', and 12*c*', respectively, one rear holder 52 e.g. being of the type illustrated in FIG. 4*a* and attached via 12*f*', and an iron tip holder 31 are provided on the base plate 11. In a practical implementation, when attaching an iron to the iron holder, e.g. being placed on a horizontal surface, the iron tip is inserted into the iron tip holder, roughly in a horizontal direction. When inserted into the tip holder the iron may be moved vertically downwards. The side and rear holder are situated such that the iron fit precisely in between the side and rear holders. If provided, the distance means will finally stop the vertically downward movement. If the iron tip holder is provided with a spring mechanism, the iron will become securely locked to the iron holder, by pressing the iron against the side and the rear holder.

Depending on the type of side and rear holders the iron may optionally be further moved, according to the following.

In an embodiment the width w of the rail of a rear holder, indicated in FIG. 4, is shorter than the depth p of the iron tip holder indicated in FIG. 3. To securely fasten the iron to the iron holder, according to this embodiment, the iron tip may first be inserted into the iron tip holder and then the iron may be moved backwards (when the iron holder is horizontally oriented) and securely becomes fixated towards the rail of the rear holder. This embodiment is particularly advantageous when the iron holder is placed in a vertical orientation, such that the gravity forces the iron to press against the rear holder rail. As the iron tip holder depth is larger than the width of the rear holder, the tip of the iron will not be able to fall out of the iron tip holder. To detach the iron from the iron holder, the iron is simply moved vertically upwards, and hence becomes free of the rear holder rail.

If the rear holder is equipped with a spring, as explained above, the rear holder may be pulled back during the downward movement of the iron and then be released when the iron is in position to securely fasten the iron between the iron tip holder and the rear holder. In some embodiments the top of the rail 42 of the rear holder is slightly sloped or inclined, which provides for that no manual pull back of the spring is necessary when the iron is on the vertically downward movement. Instead, the iron heating surface will, when encountering the top of the rail 42, press the rear holder horizontally backwards, i.e. in the direction away from the iron tip holder, until the iron is in position such that the rear holder rail is aligned with the iron recess. When this happens the rear holder rail snaps or connects to the recess by the pressing action of the spring and securely fasten the iron in the iron holder. The same technique of attaching and detaching the iron to the iron holder may be used when the rear holder is of the type discussed in association with FIGS. 4*a*, and 4*c*, namely screw, nail, curved cylindrical structure, wherein the top portion or end portion of the holding means will attach to the recess above the iron heating surface.

The side holders provide extra stability to the iron holder and will prevent the iron from moving sideways, when the iron is placed in the iron holder. In some embodiments a side holder may be equipped with a spring, as explained above, exerting force on the iron holder. In yet other embodiments the side holders are of the type explained in accordance with any of FIGS. 4*a*-4*d*.

In an embodiment wherein more than one side or rear holder is equipped with a spring a spring release mechanism is provided so that all springs are released simultaneously to enable quick detachment of the iron.

In an embodiment the iron holder comprises a hanging means 55 which may be used to hang the iron holder, optionally comprising an iron, on a hanger or any other means enabling hanging in vertical orientation, such as a hook, knob, etc. This provides for easy storage of the iron holder.

Ironing Board

Figure 6A:
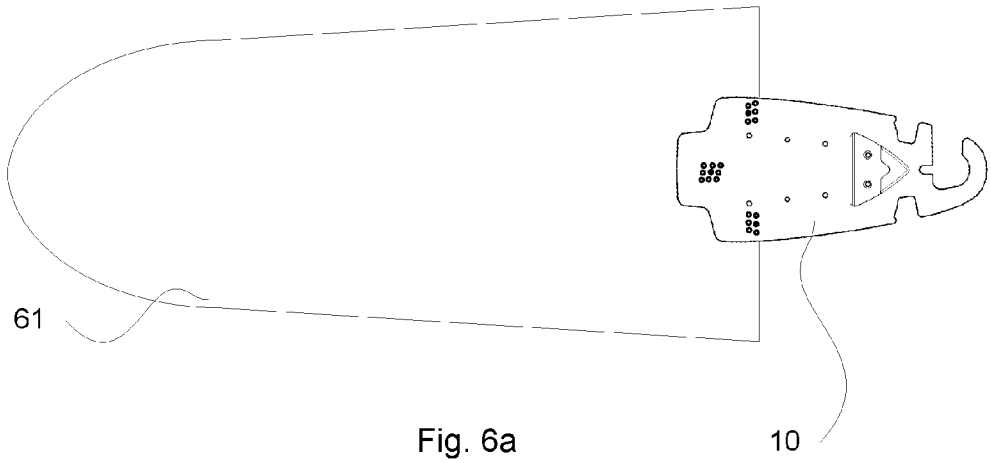
FIGS. 6*a*, 6*b* illustrates optional placements of the iron holder according to some embodiments on the ironing board.
Figure 6B:
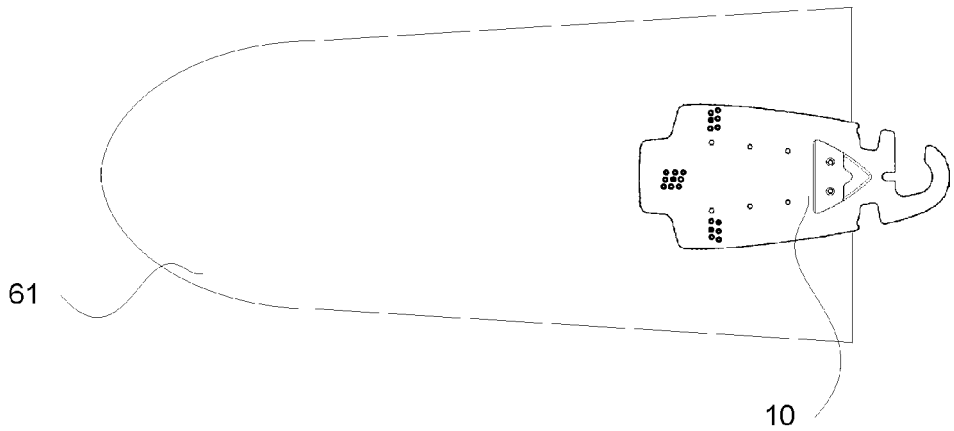

The iron holder 10 according to some embodiment may be attached to an ironing board 61 by means of the indentations 12, 22, etc. In some embodiments, the iron holder is fastened to the indentations located near the lower end of the base plate, i.e. near the indentations for the rear or side holder. Accordingly, the iron holder enables to be fastened to the ironing board such that a part of the base plate is located outside the ironing board and a part of the base plate is located on top of the ironing board. FIGS. 6*a* and 6*b* illustrates two optional placements of the iron holder on an ironing board.

In another embodiment the iron holder, is mounted on an ironing board by means of an attachment screw (not shown), which enables the iron holder to rotate around the attachment screw, and thus the ironing board. In this way the iron holder may be rotated in use such that a maximum of ironing board area will become available for ironing, and at the same time during storage, the iron holder may be rotated such that a minimum of space is required to store the iron holder and the ironing board. In this embodiment the iron holder will be rotary connected to the ironing board at all times and simultaneously save space during storage and this may e.g. be advantageous within the hotel industry, etc.

When the iron holder is mounted on an iron board the iron board, comprising the attached iron holder, may be hanged in a vertical orientation, to thereby store the iron board comprising the iron holder in a wardrobe etc.

In another embodiment the iron holder comprises a cable holder 56, around which the iron power cable may be winded. Moreover, the iron holder may be equipped with a cable holder mouth 57, in which the iron power cable may be attached just before the iron power cable connector to securely lock the iron power cable to the iron holder. The cable holder 56, and cable holder mouth 57 solve the problem of loose hanging power cables during storage.

Figure 7A:
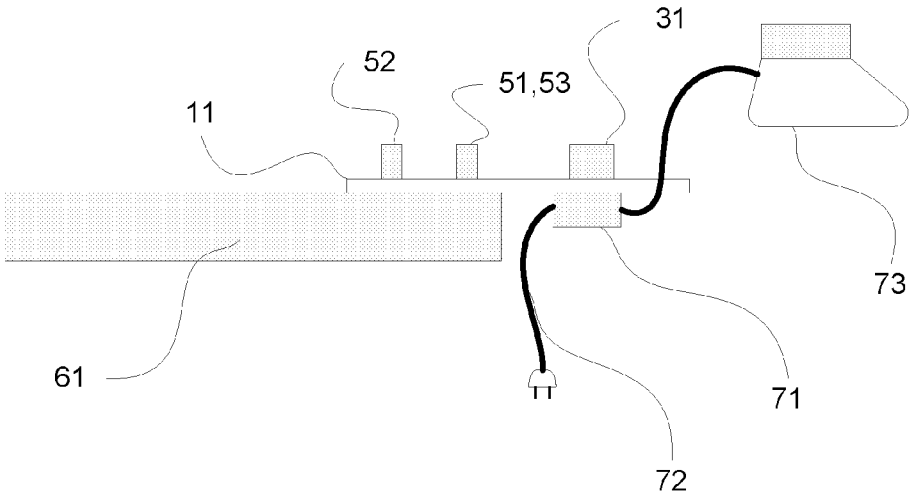
FIGS. 7*a*, 7*b* is an illustration showing an iron holder being configured with a cable locking means according to an embodiment.
Figure 7B:
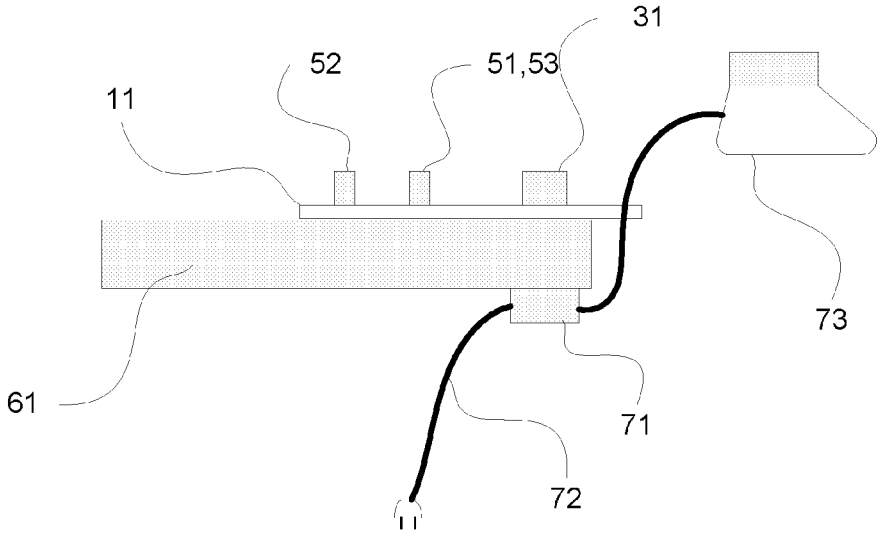

In an embodiment, according to FIGS. 7*a* and 7*b*, a cable-locking unit 71 is provided on the iron holder. The function of the cable-locking unit 71 is to fasten the power cable 72 of an iron 73 to the iron holder such that the iron may not be separated from the iron holder, or the ironing board if the iron holder is connected to an ironing board. The cable-locking unit may be attached to the ironing board via any of the indentations provided in the base plate. The cable-locking unit provides for the advantage of preventing or at least make it more difficult to steal the iron. FIG. 7*a* illustrates one optional placement of the cable-locking unit 71 and FIG. 7*b* illustrates a second optional placement of the cable-locking unit.

When placed on a ironing board or hanged on a hanger the iron holder will keep the heating surface of the iron in a covered position, such that the heating surface will not pose a threat to the health of the user or pose a risk for setting fire to flammable materials.

The iron holder according to some embodiments of the invention allows for fixation of an iron, such that the iron holder, and thereby also the iron housed therein, may be moved in all directions without the iron falling off the iron holder, while simultaneously keeping the heating surface of the iron in a covered position, such that the heating surface will not pose a threat to the health of the user or pose a risk for setting fire to flammable materials. Based on the design of the iron holder, it allows for minimized discrimination between left and right-handed users. Furthermore, the iron holder according to some embodiments minimizes the storing space of the ironing equipment, such as the iron, ironing board, etc.

Turnability of the Iron Holder

According to some embodiments the base plate of the iron holder is provided with indentations in the form holes provided straight through the base plate. In this way the holding means may optionally be placed on either side of the base plate and thus provides a turnability feature. This turnability provides a number of advantages. An advantage is that the iron holder becomes more versatile and may be fitted in cabinets having varying design, and places having limited space. As an example, in the hotel industry, each hotel room comprises a variety of user services, such as TV, etc., and there is a very limited space for each user service as the hotel tries to maximize the number of rooms per surface unit. Accordingly, a cabinet having a hanging pole for hanging clothes may be provided in each room. In this case the iron holder, according to some embodiments, may be hanged utilizing the hanging means 55 on the hanging pole. For easy hanging/unchanging of the iron holder it is required that the hanging means 55 could be fitted around the hanging pole in a straight in and straight our motion. Accordingly, if it is required that the iron holder should be placed to the left in the cabinet, the holding means according to some embodiments may be placed on a first side of the base plate. However, if it is required that the iron holder should be placed to the right in the cabinet, hence the holding means may be provided on the other side of the base plate. In this way, the iron holder according to some embodiments may be adapted, and accordingly this provides for increased flexibility and user friendliness compared to current solutions.

In another embodiment one side of the base plate may be provided with a first color or texture, and the other side with a second color or texture. In this way by attaching the holding means e.g. to the first side of the base plate a first appearance of the iron holder will be provided, and by attaching the holding means to the second side of the base plate a second appearance of the iron holder will be provided. Accordingly, the iron holder is more versatile and provides for increased flexibility and user friendliness compared to current iron holder solutions.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. An iron holder comprising, a base plate configured to attach a holding means by means of a set of indentations, wherein said holding means comprises:

an iron tip holder having a rail for fitting into a recess or groove situated vertically above the heating surface of an iron, said rail extending at least partly along the sides of said iron, a rear holder mounted on said base plate by means of an indentation for providing a stopping action of the iron in a direction away from the iron tip holder, whereby the iron is prevented from moving out of the iron holder in the plane parallel to the base plate, and a first side holder, and a second side holder, each cooperating with the sides of the iron when the iron is placed in the iron holder, wherein the first side holder is attached to either a first indentation or second indentation of said set of indentations, and wherein the space for reception of the width of the iron, between the first side holder and second side holder, is dependent on to which of the first or second indentation the first side holder is attached.

2. The iron holder according to claim 1, wherein the second side holder is attached to either a third indentation or fourth indentation of said set of indentations, and wherein the space for reception of the width of the iron, between the first side holder and second side holder, is dependent on to which of the third indentation or fourth indentation the second side holder is attached.

3. The iron holder according to claim 1, wherein at least one indentation is a hole, extending straight through the base plate.

4. The iron holder according to claim 1, wherein the first and second indentation or third and fourth indentation constitute an elongated hole extending straight through the base plate.

5. The iron holder according to claim 1, wherein at least one indentation have a threaded portion capable of attachment to a screw or any other object having a corresponding threaded portion.

6. The iron holder according to claim 1, further comprising a distance means being fastened to said base plate, providing a distance between the iron and the base plate or between the iron holder and a surface, on which the iron holder is located.

7. The iron holder according to claim 1, wherein the rear or side holder comprises a rail adapted to fit into the recess situated vertically above the heating surface of the iron.

8. The iron holder according to claim 7, wherein the width (w) of the rail is less than the depth (d) of the iron tip holder rail.

9. The iron holder according to claim 7, wherein the top of the rear or side holder rail is sloped or inclined.

10. The iron holder according to claim 1, further comprising a hanging means.

11. The iron holder according to claim 1, further comprising a cable holder.

12. The iron holder according to claim 1, wherein said first side holder, said second side holder, said rear holder, or said tip holder is attached to said base plate on a first side by means of a nut provided on the opposite side of said base plate for receiving and securely locking said first side holder, said second side holder, said rear holder, or said tip holder, respectively, via said indentation.

13. A base plate for being comprised in an iron holder, wherein said base plate is configured to attach a holding means by means of a set of indentations provided thereon, wherein said holding means comprises a first side holder;

a second side holder, each cooperating with the sides of an iron when the iron is placed in the iron holder, wherein the first side holder is attached to either a first indentation or second indentation of said set of indentations, and wherein the space for reception of the width of the iron, between the first side holder and second side holder is dependent on to which of the first indentation or second indentation the first side holder is attached; and an iron tip holder having a rail for fitting into a recess or groove situated vertically above the heating surface of an iron, said rail extending at least partly along the sides of said iron; or a rear holder mounted on said base plate by means of an indentation for providing a stopping action of the iron in a direction away from the iron tip holder, whereby the iron is prevented from moving out of the iron holder in the plane parallel to the base plate.

14. The base plate according to claim 13, wherein the second side holder is attached to either a third indentation or fourth indentation of said set of indentations, and wherein the space for reception of the width of the iron, between the first side holder and second side holder is dependent on to which of the third indentation or fourth indentation the second side holder is attached.

* * * * *